United States Patent [19]

Reccius et al.

[11] Patent Number: 4,974,434

[45] Date of Patent: Dec. 4, 1990

[54] CONTROLLED SHOT PEENING

[75] Inventors: Helmut Reccius, Munich; Rolf Meyer, Egling, both of Fed. Rep. of Germany

[73] Assignee: Dornier GmbH, Friedrichshafen, Fed. Rep. of Germany

[21] Appl. No.: 379,567

[22] Filed: Jul. 12, 1989

[30] Foreign Application Priority Data

Jul. 13, 1988 [DE] Fed. Rep. of Germany ..... 3823675

[51] Int. Cl.[5] ..... B21D 1/02

[52] U.S. Cl. ..... 72/53; 72/75; 29/81 D; 29/90.01; 29/90.3; 81/20; 81/26

[58] Field of Search ..... 29/90.7, 81 A, 81 J, 29/81 D, 90.01, 90.3, 90.5; 72/53, 75, 76, 478, 110; 81/20, 25, 26

[56] References Cited

U.S. PATENT DOCUMENTS

| | | | |
|---|---|---|---|
| 3,444,714 | 5/1969 | Gustkey | 72/76 |
| 3,478,558 | 11/1969 | Hoffman et al. | 29/90.01 |
| 3,827,270 | 8/1974 | Neilsen | 72/53 |
| 3,934,443 | 1/1976 | Keen | 72/76 |
| 3,945,098 | 3/1976 | Yascheritsyn et al. | 72/76 |
| 4,008,593 | 2/1977 | Ciccarello | 72/75 |
| 4,593,767 | 6/1986 | Isenring | 29/81 D |
| 4,641,510 | 2/1987 | Mitsching et al. | 72/53 |

FOREIGN PATENT DOCUMENTS

| | | | |
|---|---|---|---|
| 904559 | 7/1972 | Canada | 72/53 |
| 1948752 | 4/1971 | Fed. Rep. of Germany | 72/75 |
| 3601541 | 7/1987 | Fed. Rep. of Germany | 72/53 |

*Primary Examiner*—David Jones

*Attorney, Agent, or Firm*—Ralf H. Siegemund

[57] ABSTRACT

A device for bending or levelling workpieces by means of shot peening is improved by controlled impacting and indenting using a support element having a rear wall and side walls; a plurality of force spaced apart distributing elements are arranged in the support element and in the least one layer so that at least some of them abut the rear wall of the support element; a plurality of indenting, shot peening elements in engagement with at least some of the force distributing elements in that any of the shot peening elements engage at least two of the force distributing elements; there are elements of one of the plurality which abut the side walls of the support element.

18 Claims, 2 Drawing Sheets

FIG. 1
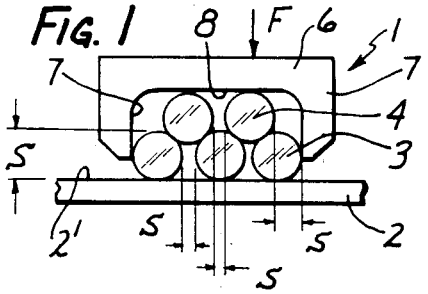
FIG. 5
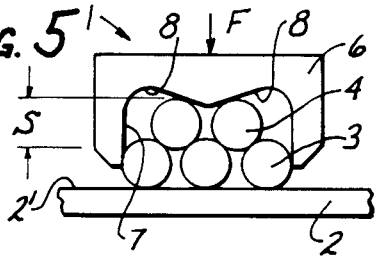
FIG. 2
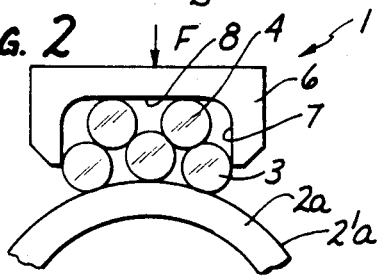
FIG. 6
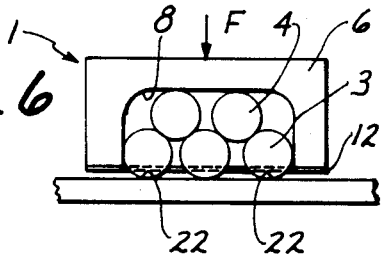
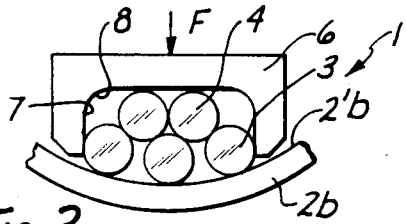
FIG. 3
FIG. 7
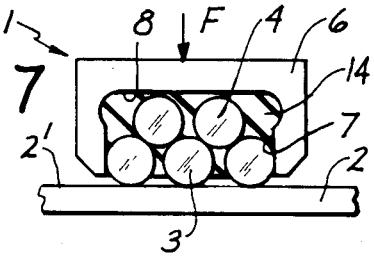
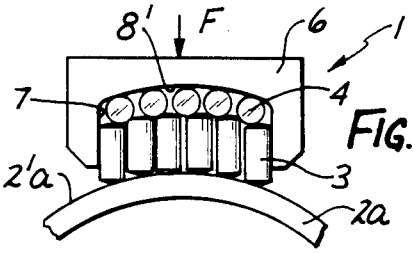
FIG. 4
FIG. 8
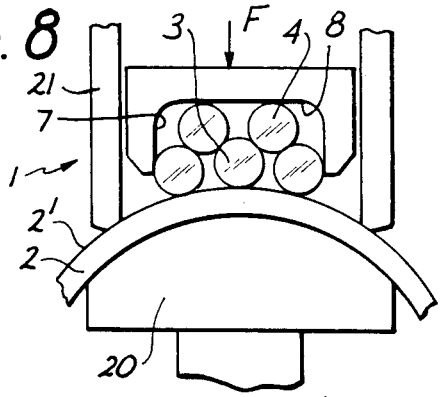
FIG. 9
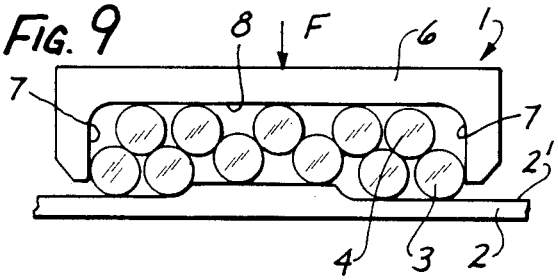
FIG. 10
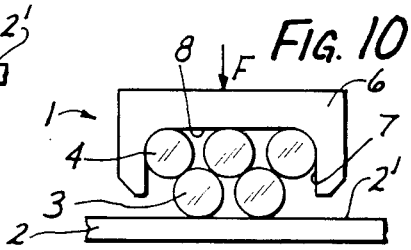

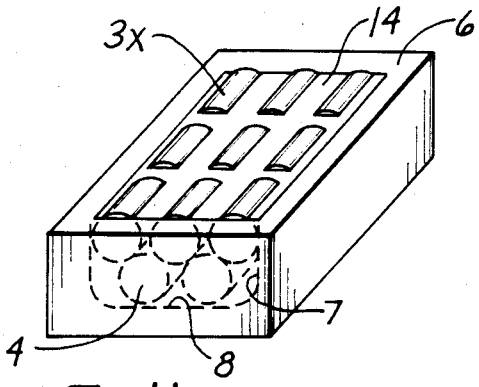
FIG. 11
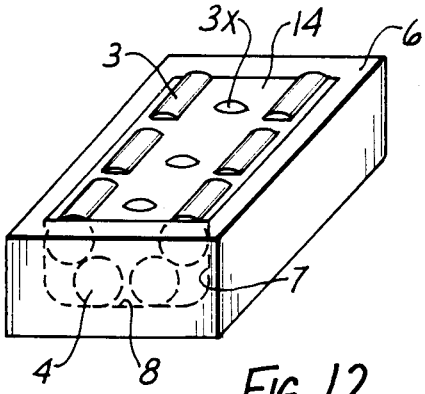
FIG. 12
FIG. 13
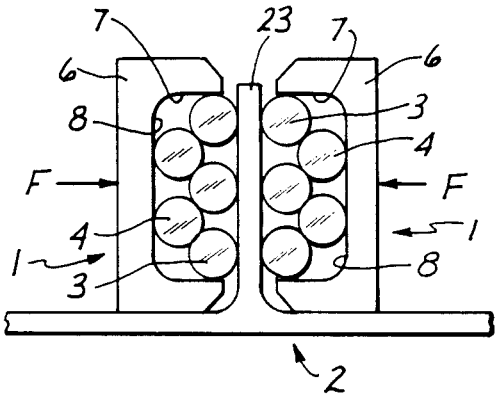
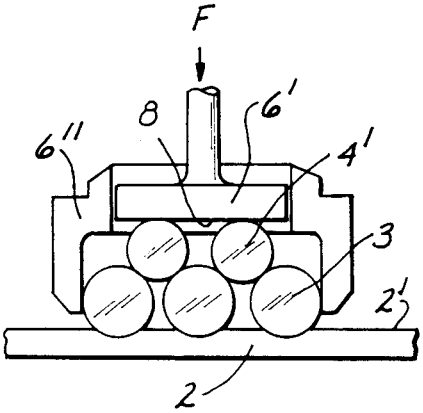
FIG. 14
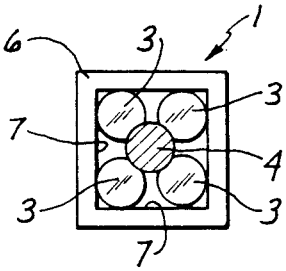
FIG. 15
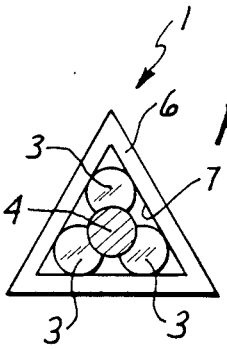
FIG. 16

CONTROLLED SHOT PEENING

BACKGROUND OF THE INVENTION

The present invention relates to the bending, levelling and straightening of workpieces by causing in the plastic deformation changes, and more particularly the invention relates to the bending, levelling and straightening of workpieces having combined plastic and elastic properties, under utilization of impacting elements which indent the material to be deformed for purposes of displacing and moving material so as to obtain changes in shape under utilization of acceleration and force application to the impacting or indent elements which provide for the deformation.

The deformation of workpieces made of material which are both, elastic as well as plastic, concerning any deformation, are known in a variety of ways and they are known as shot peen forming. This particular method of deforming is used e.g. for shaping the skin elements for the fuselage of an airplane or for wings of aircraft or for certain cell structures in space vehicles. In this case then one uses impact bodies (shot) in the form of steel balls or balls of any other material but of comparable hardness, or peening elements which are not balls but having other configurations. Forming and deforming of platelike or sheetlike workpieces obtains as a stream of shot moves towards the workpiece and performing local, peeninglike indentations. This working is carried out particularly on panels being constructed as integral components and to be used within certain assemblies; the integration involves particularly stiffening ribs on one side of the panel. Here one uses the indents (peening) bodies to impinge against the workpiece such that the peening bodies indent the surface of the workpiece. This procedure entails compacting of the material i.e. increasing its density, as well as material displacement which of course will result in an overall deformation if only one side of the object is affected.

The impact onto the workpiece to be deformed may e.g. involve free fall of the indenting and peening bodies and elements, from a particular height, and the indenting will depend also on the dimensions of the impact bodies or peening elements. The distribution of peening elements may provide a uniform or a nonuniform areal distribution as far as impact and indenting density is concerned. In a known form of practicing this method, small impact and peening bodies are accelerated in a suitable fashion e.g. by means of air or liquid or the shot is physically impelled through slings or the like. Other devices are known by means of which impact and indent bodies are individually accelerated through guide elements. Devices are also known for shaping and orienting sheet parts under utilization of indenting bodies arranged in a holder which penetrating bodies are rigid and oriented in relation to the plane.

The shot peening method using indenting bodies in forms of streams and/or fronts or shot and regardless of whether acceleration is used through gravity, gas or any other way, has as an inevitable side effect a significant scattering of the impacting peening bodies as the impinge on the workpiece. The scattering results from physical interaction and bouncing between bodies as they move towards the part but primarily of course through bounce back and reflection, back into the oncoming balls and shot. This reflection results on the average, in a significant scattering of the oncoming shot. Also a certain lack in homogeneity e.g. due to turbulence or the like provides for a difference in acceleration and therefore constitutes another scattering effect. Consequently these scatter effects produce certain tolerance zones including e.g. an imprecision in the boundary of the portion being deformed. Also, for statistical reasons random accumulations in excess of the normal impact and therefore excessive material displacement and irregular tension distribution seems unavoidable. Nonuniform material displacement is also the result of the fact that the impact bodies will impinge on the workpiece surface as straight on i.e. at right angles only in the average. In most instances there will be a lateral component.

DESCRIPTION OF THE INVENTION

It is an object of the present invention to provide a new and improved arrangement, device, equipment and apparatus for obtaining deforming and levelling and other reorienting of workpieces such as panels, with or without stiffening ribs or the like, by means of controlled shot peening through the use of uniform distribution of the deforming force as far as peening shot is concerned and in conjunction with the matching of this force distribution to the desired contour with the possibility of matching and changing the requisite forces as the contour changes as a result of the working process.

It is also an object of the present invention to provide a new and improved deforming unit of the shot peening variety wherein the area, zone or region to be deformed can be deliniated accurately and the particular locus of deformation can also be determined quite accurately particularly under utilization of the penetrating speed of the elements as far as the workpiece surface is concerned.

In accordance with the preferred embodiment of the present invention it is suggested to provide a force for acting on the workpiece under utilization of a support element or carrier which receives a plurality of impact and indenting elements (peening shot) and which includes force distributing elements which engage the impact and indentation elements and provide for a transmission of force upon them whereby each force distributing element coacts with at least two impacting and indenting elements to obtain the uniform distribution of the force upon these adjacent indenting elements and whereby either the indenting elements or the distributing elements, or both kinds depending on their location, bear against support wall surfaces of the support and element carrier, transversely or parallel to the desired direction of force as the case may be. It is further suggested that between adjacent indent elements and/or adjacent force distributing elements and between some of these elements and the support walls of the support carrier, a certain play and space is provided being of course smaller than representative transverse dimensions to any of the elements. Some means are provided to retain all these elements in the carrier.

The invention, basically, uses a level or layer of peening shot to obtain the indenting (peening) and this shot layer is laterally contained by the carrier, while forces of action are transmitted upon the peening shot and indent elements from the rear, through at least one other layer of elements upon which acts the back wall of the carrier. The elements of this back row or layer of force distributing elements may yield individually laterally to thereby permit the contour of the layer of peening shots to adapt itself to the workpiece contour.

The inventive equipment permits very accurate determination of an area that is subjected to the indent peening simply through the lateral retention of the indenting elements in relation to each other and by and to the holder. Patterns can be provided in a cumulative fashion or at least corresponding to the contour of the holder covering particular loci and areas of the workpiece. This approach renders the deformation highly predictable, and the degree of deformation is accurately reproducible which of course is important for mass production. Also, there is an automatic matching and adaptation of the impact elements onto the contour of the workpiece including any change in contour during deformation as indenting progresses. This adaptation then renders deformation uniform as far as the distribution of the impact of the shot peening elements is concerned and concerns particularly the force distribution among all of the peening shot and indent elements. The adaptation of these elements as to a changing contour obtains particularly through the retention function of the lateral support of the indenting elements and/or of the force distributing elements in conjunction with the play between the indenting elements and the distributing elements on one hand and the representative walls of the support structure on the other hand.

The guiding and holding of the indenting elements in the support causes the impact force to be always effective transversely or nearly transversely to the surface of the workpiece. The holding of the peening elements through force distributing elements and the side wall of the support prevents uncontrollable lateral displacement of the indent elements and thus avoids any irregularity in the material distribution over and beyond what is desired. In particular the angle under which force can be introduced and act upon the workpiece is highly controllable. The random distribution of scattering is in fact avoided by the effect of the distributor elements.

A further advantage of the inventive configuration over the known prior art devices is to be seen in that the impact speed by means of which the impacting and indenting elements interact with the work material, is highly controllable over the entire period of impaction. Further advantages can be seen in that the indenting element can be of a known configuration such as steel balls which is conventional for shot peening also usable as cylindrical, roller-like elements or barrel-shaped i.e. convexly bulging elements as they are used in roller bearings of various kinds. In other words these kinds of elements are readily available for other purposes and can be used in the inventive equipment. In fact the indenting elements and the distributor elements are the same in other words, peening shot can be used for the distribution elements. All that has to be done is to make a support element which receives and retains these elements. Owing to the lateral play which is intentionally included in the placement of the indent elements; and the play between adjacent force distributing elements and between any of these elements and the support, one obtains an automatic matching of the position of the impact elements to the possibly curved contour of the workpiece to be deformed including working stiffening ridges or the like.

The configuration of the support surface in the holder defines the initial layer contour of indent and force distributing elements to match this tool to the initial contour of the workpiece, still permitting dynamic adaptation as the curvature of the workpiece changes. This is done by holding the impacting elements within a definite confine and permitting the force distributing elements to narrow or spread. That narrowing is translated into a change in curvature of the layer of indenting elements and that change in turn is effective as a contour adaptation. For reasons of versatility in the adaptation, more than one layer of force distributing elements can be provided.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a schematic section view of a device in accordance with the preferred embodiment of the present invention for practicing the best mode thereof by the workpieces assumed to be planar panels;

FIG. 2 illustrates the same arrangement of FIG. 1 acting on a convex workpiece;

FIG. 3 shows still the same deforming equipment but working a concavely shaped panel;

FIG. 4 is a section view of a deforming structure using differently contoured indenting elements for the deformation and distribution of forces;

FIG. 5 is a shot peening structure including a support element of a particular contour to obtain a particular distribution of the indenting and deforming elements held therein;

FIG. 6 and FIG. 7 show an example of the invention in side view with different holding structures for retaining elements in the support and carrier;

FIG. 8 is an arrangement using a deforming element of the kind already described but with additional support and guiding structure for a particular hold down positioning and so forth;

FIG. 9 illustrates a modified structure for deforming in conjunction with a stepped workpiece;

FIG. 10 shows an example similar to FIG. 1 but cylinders are used as deforming elements;

FIG. 11 is a somewhat schematically isometric view showing force distributing elements and indenting elements of a cylindrical configuration;

FIG. 12 illustrates an isometric view similar to FIG. 11 but with different kinds of distributor and indenting elements;

FIG. 13 is a section view of practicing the invention for deforming stiffening ribs;

FIG. 14 is a section view of a support element which includes a plunger;

FIG. 15 is a device in cross section demonstrating how a single force distributing element coacts with four indent elements; and FIG. 16 is a view similar to FIG. 15 but showing a triangular holder configuration.

Proceeding now to the detailed description of the drawings, FIG. 1 illustrates a work unit which includes a holder or support element 1 with a bottom or base support 6 and side walls 7. This implement 1 will be mounted in a suitable tool holder and reciprocating device such as hammer driver that operates pneumatically or the like and exerts a force F upon the unit 1 so as to propel that unit as a whole in the direction of that force.

The support unit 1 holds, by way of example, a plurality of indenting and shot peening elements 3 such as steel balls. These shot peening and indent producing elements 3 are arranged in a front layer facing the workpiece. In addition, support element 1 holds a plurality of force distributing elements 4 which can be the same in terms of structure i.e. they are steel balls similarly configured as the elements 3. They are simply, so to speak, arranged in a layer of balls or spheres in the back or behind elements 3 and they are specifically disposed between the back wall 6 of support 1 and the layer of balls 3. Moreover elements 4 are arranged in a layer. The elements 3 do the actual peening work while the force distributing balls 4 as arranged in their back, transmit the working force from the back wall surface 8 of the support 1 to indenting elements 3.

A particular case is illustrated in FIG. 1 wherein a workpiece 2, which has a surface 2' that is planar, and the force F extends transversely to that direction. As stated, the force distributing elements 4 bear against the surface 8 of back wall 6, but each acts in this case on certain balls 3 (at least two). Also several balls 3 act in a transverse direction against the wall surfaces of the side walls 7 to obtain retention of the balls 3. This retentive support generally is transverse to the direction of the force. Primarily, the walls 7 confine the balls within a limited space. FIGS. 2 and 3 differ from FIG. 1 by the contour of the workpiece 2 whereby as a consequence the balls in the spatial arrangement within the holder 1 are arranged.

As stated the balls 3 and 4 are e.g. steel balls as they are commonly used in ball bearings can be used as peening shot. It may be assumed moreover that in elevation the holder 1 has a square shape so that nine balls 3 are provided in the working layer with four balls 4 for that layer in the back. These four balls 4 establish the force distributing layer. The ball configuration of course is the result of square shaped arrangement of the walls 7, and the rear wall 6 and its surface 8 provide broadly speaking a space which is open to the workpiece and that open space receives the peening shot balls 3 as well as balls 4. The space is dimensioned on one hand to obtain the nine-and-four ball configuration outlined above but in addition the configuration is chosen such that there is a play between adjacent balls 4 as well as between adjacent balls 3 as far as the configuration shown in FIG. 1 is concerned. In addition there may be a cage structure 12 or other structure retaining all the balls in position. this will be explained more fully with reference to FIGS. 6 and 7.

As the force F acts on the element 1 the balls 3 indent the surface 2' of workpiece 2 and displace material therein in a calotte shape. This displacement depends on the contour and dimension of elements 3 as well as of the force F in relation to the mechanical and material properties of the workpiece 2. Looking at the situation in greater detail it appears that the back wall 6 of holder element 1 in effect acts primarily on the forced distributed elements 4 and these elements 4 act in turn on the peening, indenting and deforming ball elements 3. Uniform spacing obtains as said above in the case of a planar workpiece 2 but if the contour of the workpiece is a different one, just as is shown in FIGS. 2 and 3, then the layer of balls 3 is curved, while lateral spacing of the balls 4 of the forced distributing layer is changed to permit, through enlargement of some spaces and diminishing of other spaces a matching of the arrangement of the layer 3 to the contour of the surface 2' of workpiece 2.

It is shown in FIG. 2 that the balls 4 are somewhat spaced apart (workpiece **2*a*). In case of FIG. 3 i.e. in case of a concave surface to be worked the balls 4 are more closely spaced. The spacing between opposing walls 7 of the holding element 1 is of course a limiting factor as far as lateral displacement of the balls 3 are concerned. Owing to this matching and in dependence upon the contour of the surface 2' one obtains a uniform coarse distribution by the indenting and working elements 3 onto and into the workpiece 2**.

One can also say that the layer of force distributing balls 4 remains planar but the spacing between these balls varies; that in turn does not change the spacing between the balls 3 as their overall spacing is determined by the distance of the wall 7. Rather this variation in force distributing balls and wall spacing is translated into a change in curvature of the layer of working balls 3. In order to avoid friction there may be lubrication provided on the walls 7.

One can readily see that the workpieces **2*a* and 2*b* (surfaces 2*a'* and 2*b'*) in FIGS. 2 and 3 can be worked as pieces of an original curved configuration, but the illustration may actually show different stages of the deformation. One can readily see that as the curvature changes the ball pattern is changed automatically. Of course there are limitations given by the maximum and minimal spacing between the walls as no more changes are possible if all of the balls 4** abut, and the spacing cannot increase beyond a ball diameter.

By way of example it can readily be seen that conceivably one begins with an arrangement shown in FIG. 2, with FIG. 1 showing an intermediate stage and FIG. 3 approaches the final stage. In other words these three figures can be understood in the sequence (2, 1, 3) to demonstrate the conversion of a convex portion to concave one if such conversion is desired.

The example of FIG. 4 shows a concave bottom wall surface 8' and in FIG. 5 is shown a convex bottom wall surface 8''. They affect of course the contour and positioning of the force distributing elements. In FIG. 5 it has primarily an influence in the spacing. FIG. 4 shows also the case of a larger number of force distributing elements being in a curved layer corresponding to a concave wall contour of rear wall surface 8'. The primary aspect of FIG. 4 is that owing to the concave contour of the layer of force distributing balls 4 there is a kind of focusing of the force in that the forces act between the balls 4 and the cylindrical elements 3' in this case are all at an angle. In other words the straight on force F is reconverted by the particular contour of surface 8' and by operation of the layer of force distributing balls 4, to have a certain inwardly directed focusing effect.

As a consequence one can see that the local force as it is affected on a curved surface such as **2*b'* is in fact always normal locally to the force and provides for microcontrol in the displacement. It was assumed above that primarily for purposes of simplifying explanations of the elements in the force distributing layer and the elements 3 are the same. There is no principal reason for such a requirement. Variations here immediately permit the variations in the application of invention. It was already mentioned with reference to FIG. 4 but should be repeated with reference to FIG. 11 and 12, as well that cylindrical and barrel shaped elements 4' can readily be used for a shot peening deformation process. In the case of FIGS. 11, 12** certain patterns will obtain in the workpiece with oblong deformation zones and the material distribution is controlled accordingly.

Any impression produced by a peening element 3 and the resulting material displacement in the workpiece will always result in some bending about some particular axis. Owing to the use of differently formed elements 3 the bending can be controlled so that there may be different bending axes; there may be a preferred major axis and minor bending axes as far as the ultimate workpiece is concerned.

FIG. 6 shows a retaining element or cage 12 with penetrations or perforations 22 for fixing the elements 3 and 4 inside holder 1. The perforations 22 have dimensions permitting on one hand the play to be effective as far as adjusting the positions of the spheres 3, 4 in relation to each other is concerned. On the other hand cage 12 prevents the balls from falling out.

In the case of FIG. 7 the elements 3 and 4 are held inside holder 1 by means of an elastically deformable mass and filling 14. In other words, all of the balls 3 and 4 are embedded in a layer and filling 14. This mass basically fills all the spaces not occupied by the balls 3 and 4. The flexibility may be different in different zones.

As shown in FIG. 8 a counterholder may be provided supporting a workpiece 2*x* from the other side as far as the effect of the deforming balls is concerned. Here this holder 20 may also be made of an elastically deformable material. As the elasticity is controlled the balls in effect provide a change in the curvature of the workpiece. FIG. 9 is merely an illustration of a more complex surface of the workpiece and a somewhat larger deforming tool is provided, larger in terms of number of balls for deforming as well as force distribution.

FIG. 10 shows, contrary to the examples of FIGS. 1–8, that the number of balls in the layer is reversed. There is a smaller number of working and peening elements 3 and a larger number of force distributing elements 4. They occupy the bottom surface 8 of the bottom part 6 of holder 1 and provide a smaller number of deforming elements 3.

FIGS. 11 and 12 were already mentioned basically show cylindrical working elements 3*x* as well as barrel shaped force distributing elements 4. Again for reasons of holding them in position they are embedded in an elastically deformable mass 14 as far as FIG. 11 is concerned. In addition FIG. 12 shows differently contoured and configured elements 3 and 4. With this combination one can vary the patterns of material displacement affected by the force elements impressing elements 3.

The example shown in FIG. 13 demonstrates how a workpiece can be worked on from opposite sides. There is a reenforcing rib or ridge 23 being worked from opposite sides by the two holders as illustrated. They provide here a lengthening, spreading or the like of this particular bar 23 for example for purposes of straightening the particular rib 23. One could also provide a certain curving if the element 3 is effective on both sides have different dimensions.

FIG. 14 illustrates a somewhat modified support element in that in this case a plunger 6' is operated in a pistonlike opening in the bottom 6'' of holder 1. Here then one provides for further urging of the balls, in forward or retracting direction, to some extent independent from the force that acts on the holder 6 as such. In this particular example it is also shown that the force distributing elements 4' may have a smaller diameter than the working elements 3. There should be of course a limit in displacement. In other words the plunger 6' must not push all the balls out of the opening of the holder.

FIGS. 15 and 16 are shown primarily for purposes of demonstrating here the support function of the various elements. In this case a single force distributing element 4 is provided each coacting with four elements in FIG. 15 and three elements in FIG. 16, for providing the force distribution accordingly.

The invention is not limited to the embodiments described above but all changes and modifications thereof, not constituting departures from the spirit and scope of the invention, are intended to be included.

We claim:

1. A device for bending or levelling workpieces comprising:

a support element having a rear wall and side walls;

a plurality of force distributing elements in the support element arranged in at least one layer so that at least some of them abut the rear wall of the support element, the force distributing elements being spaced from each other to be able to move laterally over spacing between adjacent elements;

a plurality of indenting, shot peening round, ball or cylindrical elements for engaging the workpieces to be bent or levelled, said indenting elements being in engagement with all of the force distributing elements in that some of the indenting shot peening elements engage at least two of the force distributing elements;

elements of one of the plurality abutting the side walls of the support element;

means for retaining the elements in the pluralities in the support element; and means for applying a pressing force to the support element whereby said force applied to said support element is transferred to said force distributing elements and onto said shot peening elements such that all force distributing elements together act on all shot peening elements as a group.

2. Device as in claim 1, wherein said indenting elements or the force distributing elements or both have one of the following, a convex contour, a spherical, or a barrel shaped one, or a cylindrical or roller shaped contour.

3. Device as in claim 1, wherein said force distributing elements and said indenting elements have the same contour.

4. Device as in claim 3, wherein said indenting elements and said force distributing elements have the same dimensions.

5. Device as in claim 1, comprising a first layer of force distributing elements in the interior of the support element and a second layer of indenting elements on top thereof exposed to permit engagement with the workpiece.

6. Device as in claim 5, wherein the number of indenting elements is different from the number of force distributing elements.

7. Device as in claim 1, the force distributing elements each act on plural indenting elements, the force distributing elements being lateral movable within their respective layer plane.

8. Device as in claim 1, the bottom of the support element has portions being inclined to the direction of force.

9. Device as in claim 1, said support element having a planar bottom surface.

10. Device as in claim 8, said support element having a convexly curved bottom surface.

11. Device as in claim 8, the bottom surface of the support having a concavely curved contour.

12. Device as in claim 1, said means for retaining the elements being an embedment in said support element.

13. Device as in claim 1, the means for retaining being a cage structure in front of the support element being penetrated in parts by the indenting elements.

14. Device as in claim 1, wherein force distributing elements and impacting elements have different contour.

15. Device as in claim 1, including means for reducing friction of various parts and relations to each other.

16. Device as in claim 1, including a counterholder facing the support element across a workpiece and cooperating with the indenting elements from opposite sides as far as the workpiece is concerned.

17. A device for bending or levelling workpieces comprising:

a support element having a rear wall and side walls at least one of the walls being movable in plunger like fashion;

a plurality of force distributing elements in the support element arranged in at least one layer so that at least some of them abut the rear wall of the support element, the force distributing elements being spaced from each other;

a plurality of indenting, shot peening elements for engaging the workpieces to be bent or levelled, said indenting elements being in engagement with at least some of the force distributing elements in that any of the indenting elements engage at least two of the force distributing elements;

elements of one of the plurality abutting the side walls of the support element;

means for retaining the elements in the pluralities in the support element and means for applying a pressing force to the support element, said force applied to said support element is transferred to said force distributing elements and onto said shot peening elements.

18. A device for working workpieces comprising:

a first and a second support element each having a rear wall and side walls;

a plurality of force distributing elements in each of the support elements and arranged in each of them in at least one layer so that at least some of them abut the respective rear wall of the support element, the force distributing elements in each layer being spaced from each other;

a plurality of indenting, shot peening elements arranged in each support element for engaging the workpieces to be bent or levelled, said indenting elements being in engagement with at least some of the force distributing elements in that any of the indenting elements engage at least two of the respective force distributing elements in the respective support element;

elements of one of the plurality abutting the side walls of the respective support element;

means for retaining the elements in the pluralities in the respective support element;

the support elements being positioned to face each other so as to work on a work piece from opposite sides and means for applying a pressing force to said support elements, said force applied to said support elements being transferred to said force distributing elements and onto said shot peening elements.

* * * * *